US005951362A

United States Patent [19]

Siu

[11] Patent Number: 5,951,362

[45] Date of Patent: Sep. 14, 1999

[54] SAFETY HIGH SPEED ELECTRIC TOY VEHICLE

[75] Inventor: Wai-Hung Siu, Kowloon, The Hong Kong Special Administrative Region of the People's Republic of China

[73] Assignee: Penta Blesses Enterprises, Hong Kong, The Hong Kong Special Administrative Region of the People's Republic of China

[21] Appl. No.: 08/879,705

[22] Filed: Jun. 20, 1997

[51] Int. Cl.[6] ..... A63H 17/00; A63H 29/22

[52] U.S. Cl. ..... 446/462; 446/465; 310/68 E; 318/434

[58] Field of Search ..... 310/68 B, 68 E; 318/434; 388/903; 446/441, 457, 462, 465

[56] References Cited

U.S. PATENT DOCUMENTS

| | | | |
|---|---|---|---|
| 3,797,404 | 3/1974 | Barlow et al. | 446/441 X |
| 4,151,450 | 4/1979 | Fukuma et al. | 318/434 X |
| 4,695,267 | 9/1987 | Simmel et al. | 446/462 |
| 4,748,386 | 5/1988 | Nakanishi et al. | 318/434 |
| 4,857,784 | 8/1989 | Mukaekubo | 310/68 B |
| 4,947,091 | 8/1990 | Fukuoka | 318/434 |
| 5,017,846 | 5/1991 | Young et al. | 318/434 X |
| 5,062,819 | 11/1991 | Mallory | 446/462 |
| 5,323,075 | 6/1994 | Denk et al. | 310/68 B |

*Primary Examiner*—John A. Ricci

*Attorney, Agent, or Firm*—Burns, Doane, Swecker & Mathis, L.L.P.

[57] ABSTRACT

A high speed electric toy vehicle having a high current rating electric motor is provided with a fail-safe mechanism which would promptly operate to cut off motor power supply before the battery is burnt or the vehicle housing is melted as a result of over-current developed across an electric motor due to locking of rotary shaft under operating conditions. The fail-safe mechanism operates by detecting the presence or absence of motor motion as indicated by a motion tag which are attached to a part of the vehicle which always moves in response to movement of the motor shaft. The mechanism will cut off supply to the motor when no motion has been detected for a pre-determined time period.

8 Claims, 5 Drawing Sheets

SAFETY HIGH SPEED ELECTRIC TOY VEHICLE

FIELD OF THE INVENTION

The present invention relates generally to a high speed electric toy vehicle and, more particularly to a remotely controllable high speed toy vehicle powered by an electric motor.

BACKGROUND OF THE INVENTION

Electric toy vehicles have been a long-time favourite of young children ever since they are made available to the general consumers. Every year, numerous new types of toy come on to the toy market. Among the new comers, toys such as hand-held electronic video games have rapidly taken a large share of the market which was previously dominated by mechanical toys such as toy vehicles. In order to compete with the new generation of toys, it is necessary that the general performance and quality of modern toy vehicles must be elevated.

An important performance benchmark of a toy car is its ability to perform high speed cruising and manoevering. A toy car possessing high cruising speed and manuovering ability will almost certainly be preferred among young children for whom they are primarily designed. As a toy vehicle is typically a considerably scaled down version of a real vehicle, a cruising speed which is comparable to that of a road going vehicle would already appear to be exceedingly fast. Indeed, a toy vehicle having a cruising speed over 15 km/h is already classified as a racing toy vehicle bearing in mind that a conventional toy vehicle usually has a typical cruising speed of a few kilometers per hour.

Hitherto, most down-sized high speed vehicles are only available in the arena of model hobby vehicles which are primarily designated for adults and teenagers. In the USA and Europe, if a vehicle is legitimately to be offered to the general consumers as a 'toy', it must satisfy a series of stringent safety tests. One particular test which is widely agreed by toy manufacturers as the major barrier to the safety approval and therefore the development of high-speed toy vehicles is the test for compliance with ASTM HD271 (or EN 50088 for the European Union).

Under this test, the on-board motor of the vehicle is blocked, for example by wedging the driving wheels or by blocking the motor rotary shaft, while power is supplied to the driving motor. In the case of a remote-controllable vehicle, this is done by the remote controller which transmits a control signal to the receiver on-board the vehicle to supply power to the driving motor while the motor is blocked. Such a test, in every day life, simulates the accidental situation in which a careless child presses the rotating wheels of a toy vehicle against his body in order to feel the motion or to do other silly things.

In the absence of a fail-safe mechanism, an abnormally high electric current will flow through the motor as a result of the locked rotor if the rated power supply is still available to the motor. For a conventional low-speed vehicle having a small electric motor, this does not really matter since the fine motor core-windings would be burnt out almost instantly before the resulting heat can cause any appreciable damage.

For a high speed vehicle, however, the normal rated operating current is typically in the region of 4 to 5 A and the core winding current under blocked-rotor condition could surge to as high as 10 to 20 A. Such a high current, even with a relatively short duration, is already sufficient to burn the battery, melt the plastic bottom of a toy vehicle and may even cause fire. This is even more dangerous where the housing is metallic in which case heat conduction is much faster but less noticeable since the heat would not normally distort its appearance.

It is therefore desirable to provide a high speed toy vehicle having a fail-safe mechanism which would react promptly to a blocked-rotor situation and cut off power supply to the motor to prevent an accident as a result of over-current developed across an electric motor due to locking of rotary shaft under operating conditions. To be of practical industrial value, such a fail-safe mechanism must be relatively simple, reliable and in-expensive.

A simple conventional method to control motor over-current is, for example, by connecting the collector of a NPN-bipolar-transistor in series with the motor with the emitter connected to ground. When over current occurs, the transistor will be saturated and the drop in the collector-emitter voltage could be detected and used to cut off supply to the motor. This however would not be suitable for a more sophisticated toy vehicle having a controllable variable speed and with a high current rating motor.

Furthermore, the speed of a direct-current electric motor is usually varied by the amount of motor current. A modern approach for motor current control is usually not by means of power dissipating variable resistance but, instead, by controlling the pulse width of the supply current in order to obtain a variable average direct current level. As such, most conventional over-current control methods are not suitable.

According to the present invention, there is therefore provided a toy vehicle having an electric motor with a rotary shaft for driving said vehicle, comprising a motion tag, a motion sensor and a motion detection device, wherein said motion tag is movable in response to rotation of said rotary shaft, said motion sensor is adapted for non-contact detection of motion of said motion tag and generates a characteristic electrical signal output in response to movement of said motion tag, and said motion detection device accepts and processes said characteristic electrical signal output from said motion sensor and is adapted to trigger cut-off of power supply to said electric motor when said characteristic output signal indicates that there has been no relative motion between the motion tag and the motion sensor for a predetermined duration.

Preferably the motion detection devices generates either a monotonously time-incremental or monotonous time decremental signal level output which is reset upon detection of said characteristic electrical signal output generated by said motion sensor in response to relative motion between said motion tag and said motion sensor, if said time-incremental or time-decremental signal output is not reset before reaching a predetermined threshold signal level output, the power supply to said electric motor will be cut-off.

Preferably said motion tag comprises a permanent magnet attached to the gear disc of the transmission system of said vehicle and said motion sensor comprises a plurality of coils.

Preferably said characteristic signal output from said motion sensor indicating motion comprises a pulsed signal.

Preferably said pulsed signal is converted into a signal notch during its passage through said motion detection device.

BRIEF DESCRIPTION OF THE DRAWINGS

A preferred embodiment of the present invention will now be described and explained by way of example and with reference to the accompanying drawings in which.

DETAILED DESCRIPTION OF THE PREFERRED EMBODIMENTS

Figure 1:
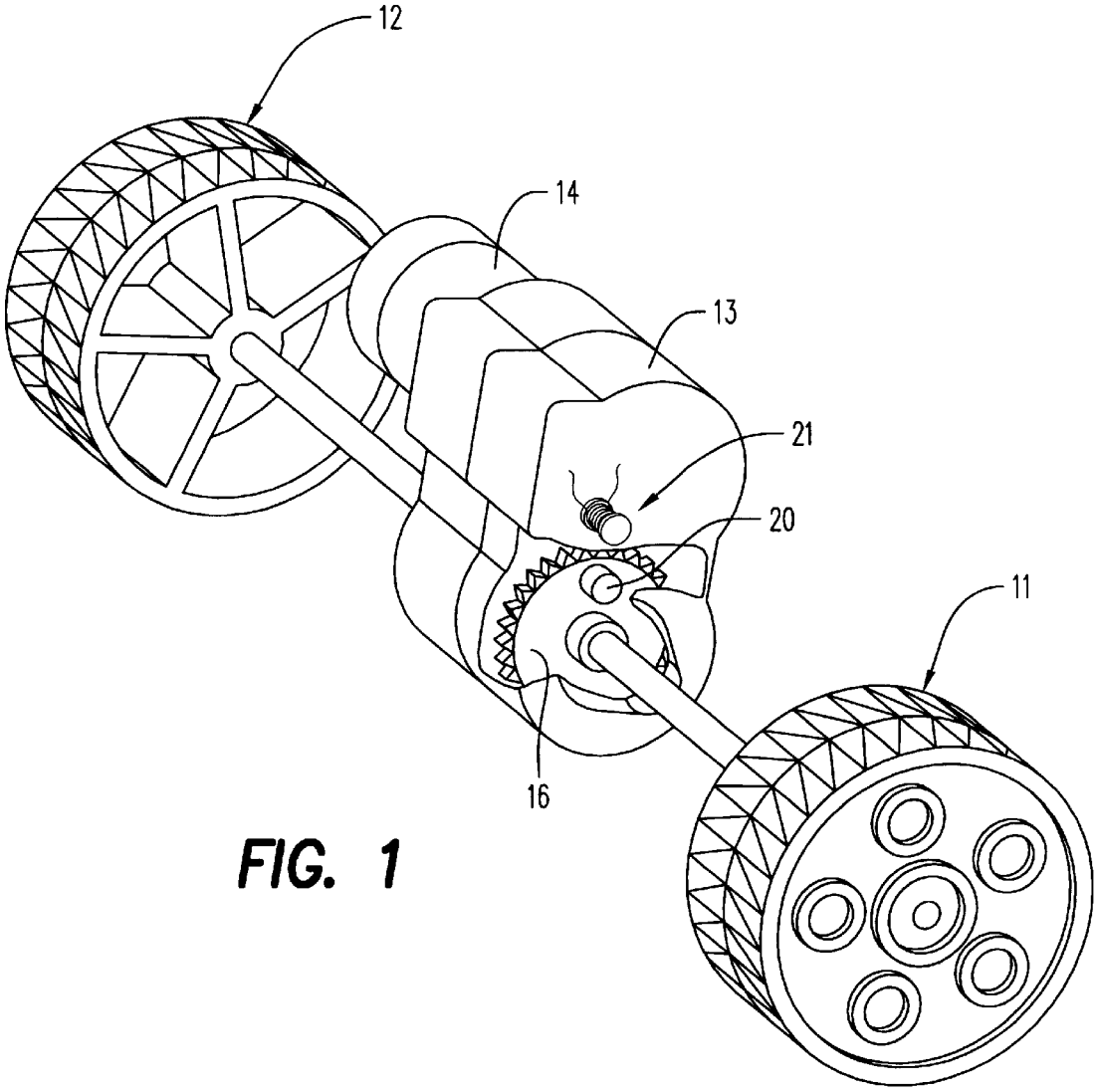
FIG. 1 is a schematic diagram showing the exploded view of an axle assembly of a toy vehicle equipped with an electromagnetic sensor.

An electric toy vehicle is usually driven by a direct current electric motor via an assembly of transmission gears which are accommodated in a rigid housing. Referring to FIG. 1, there is shown a transmission assembly which is connected to the driving wheels 11,12 of a toy vehicle and which is enclosed in a case 13 and mounted on the housing(not shown) of a toy vehicle. The input of the transmission assembly is connected to the motor shaft and its output is connected to the axles of the driving wheels.

When the rotary shaft of the electric motor 14 rotates, the transmission gears which are directly connected to the motor shaft 15 would be brought into synchronised rotation. This rotation will then be transmitted to secondary or tertiary gears for speed or torque change before finally driving the wheels 11,12. In more sophisticated toy vehicles, differential gears may be used instead. Such differential gears would have the effect that when either of the wheels 11, 12 are rotatable the motor rotary shaft would not be locked. Only when both wheels are prevented from moving would the motor be locked.

The preferred fail-safe mechanism comprises a movable motion tag, a stationary motion sensor and a decision circuit. The motion tag 20 is utilised to indicate the instantaneous rotation state of the motor shaft 15 and is therefore preferably mounted on a movable part which is directly connected to the motor shaft so that it would always move in response to the motor shaft motion. The motion sensor 21 is preferably a detection device which would detect relative motion between the motion tag 20 and the sensor 21 and produce usable electrical signal output. To minimise noise, wear and tear, the tag and sensor pair is preferably not physically contactable.

Figure 4:
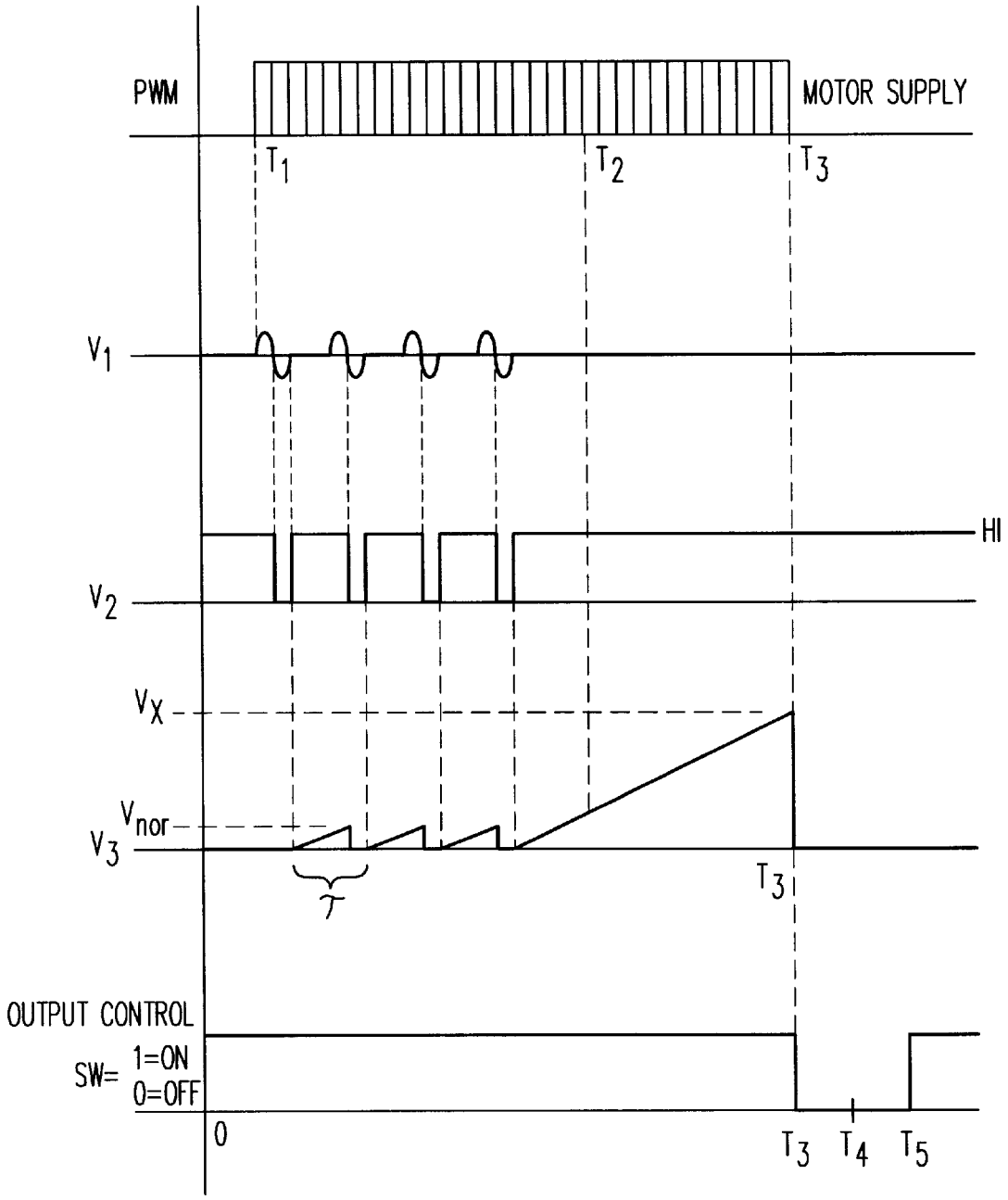
FIG. 4 is a diagram showing typical signal waveforms which appear in different parts of the sensor and detection circuit.

FIG. 1 shows a first preferred embodiment of the fail-safe mechanism of the present invention. In this preferred embodiment, the tag 20 is a piece of permanent magnet which is mounted on the plane of a gear disc 16. This gear disc 16 forms part of the transmission assembly and rotates in response to motor shaft rotation. The motion sensor 21 is a coil having a plurality of substantially co-axial wire windings. This coil is mounted on the transmission assembly casing, located adjacent to the tag 20 and is fixed with respect to the toy vehicle chassis. When the motor rotates, the rotary shaft causes the gear disc 16 to rotate, thereby producing a rotating magnetic field in the vicinity of the coil. When the rotating magnetic field interacts with the coil, voltage will be induced in the coils and a characteristic signal output in the form of electrical pulses typically as characterised by $v_1$ of FIG. 4 are produced. These electrical pulses form a train of motion detection signals which carry information relating to the rotational speed of the gear disc 16 and the motor shaft 15. The information bearing pulses are then fed to the decision circuit which will then determine whether to shut off power supply to the toy vehicle.

Figure 2:
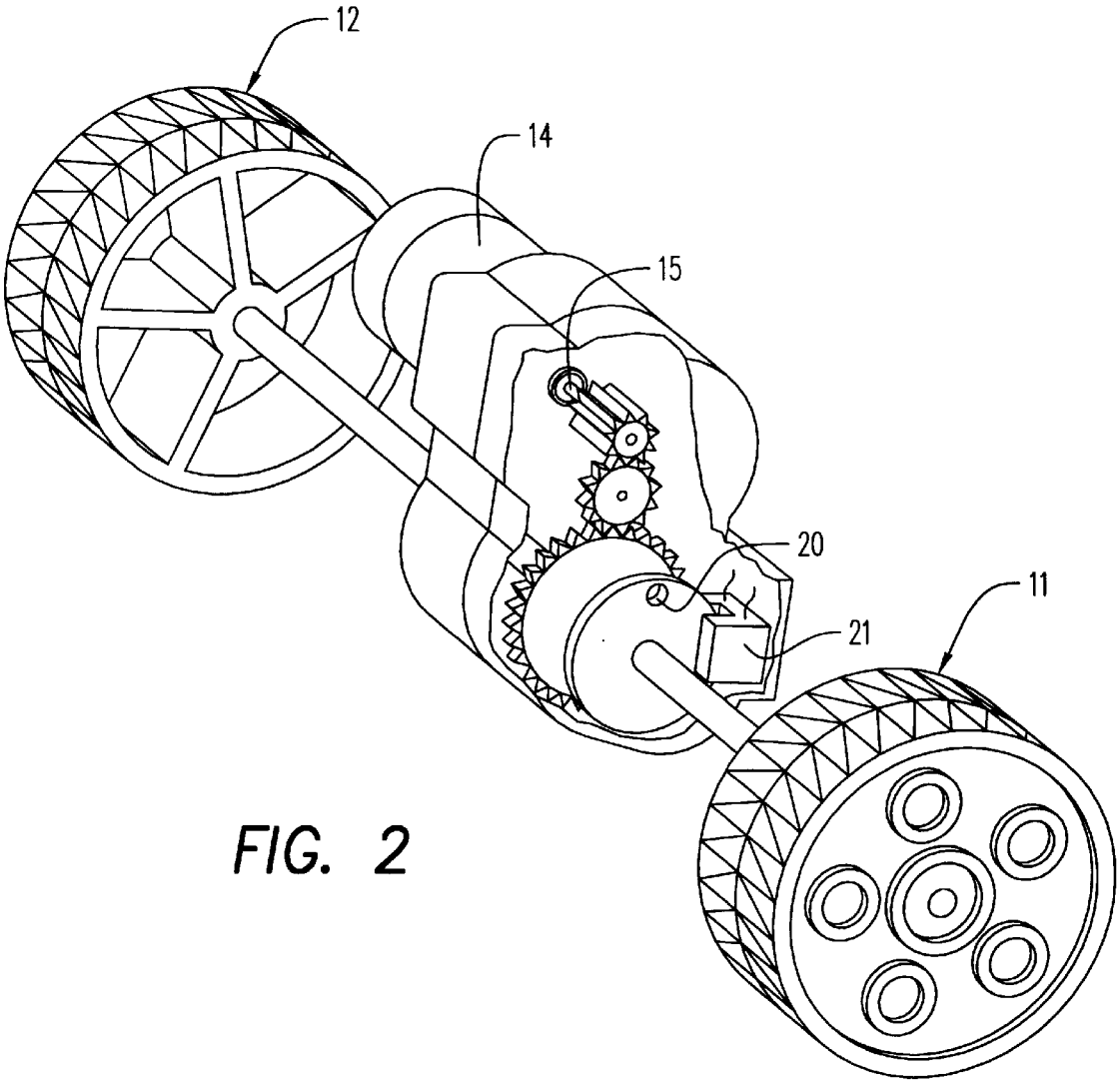
FIG. 2 shows an exploded view of an axle assembly of a toy vehicle equipped with an opto-electrical sensor.

FIG. 2 shows a second preferred embodiment of the fail-safe mechanism in which the tag 20 is an axial aperture formed on the gear disc 16. The sensor 21 is an oppositely disposed opto-electronic pair comprising an optical source and an optical detector. The tag 20 and sensor 21 pair are mounted on the gear disc 16 and assembly casing 13 respectively in a manner similar to that described in the first embodiment. When the gear disc 16 rotates, intermittent optical connection between the optical source and detector generates electrical pulses which can then be utilised by the decision circuit.

Figure 3:
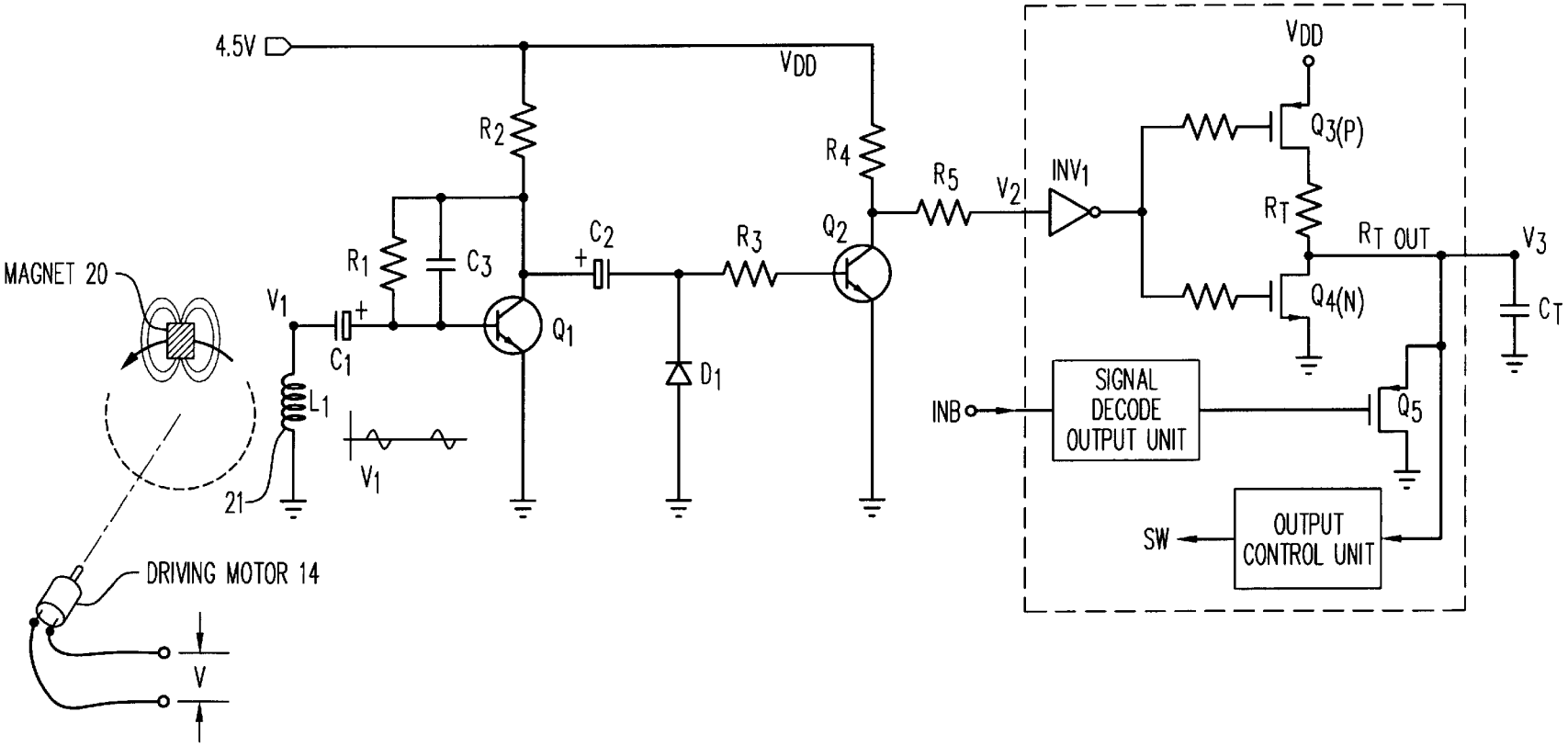
FIG. 3 is an electronic circuit diagram showing an example circuit which may be used in connection with the sensors of FIGS. 1 & 2.

An example circuit by which motion detection signals originating from the motion tag-sensor are processed in order to determine whether to shut off the power supply to the motor will now be described by way of example. Referring to FIG. 3, there is shown an example of a pulse detection circuit which is designed to be used with the magnetic motion transducer of the first embodiment. This arrangement could of course be used with other sensor pairs such as optical sensor pairs, albeit with minor circuit modifications.

In FIG. 3, the inductor L, represents the pick-up coils in the first embodiment. The signal pulse train output v, from the sensor 21 is fed into the detection circuit. The detection circuit comprises two-common-emitter stages which amplify the input signal and convert the pulse train into a notched signal train, represented schematically as $v_2$ in FIG. 4. The first common-emitter stage amplifies $v_1$ while at the same time results in a polarity inversion. In the second common-emitter stage, the $Q_2$ collector output resistor $R_4$ is always pulled high unless the input appearing at $R_3$ is positive and sufficiently high to turn $Q_2$ which will then pull the output of $R_4$ low.

A pulse train similar to $v_1$ appearing at the input will be amplified and inverted by the first common-emitter stage. In particular, when the lower half cycles of the pulse train are inverted and adequately amplified, voltage notches corresponding to the lower half cycles will appear at the $R_4$ output, thereby converting a pulse train into a periodically notched signal train, as shown schematically by $v_2$ in FIG. 4.

The $Q_2$ collector output, $v_2$, from the second common-emitter stage, is then fed into the decision part of the detection circuit. This decision circuit shown in FIG. 3 comprises an invertor $INV_1$ which is connected to the transistors $Q_3$ and $Q_4$. When $v_2$ is low, corresponding to detection of motion tag pulse, input to $Q_3$ and $Q_4$ is high, both transistors are then conducting and the output $V_3$ is pulled low. When $v_2$ is high, corresponding to non-detection of motion tag, input to $Q_3$ and $Q_4$ is low, and the output $v_3$ is pulled up. Because of the R-C time constant associated with the resistor $R_T$ and capacitor $C_T$, the voltage rise will be gradual, similar to that shown by $v_3$ of FIG. 4.

Assuming for convenience that the output voltage $v_3$ has just been reset to near the ground level as a result of a successful motion detection and $v_2$ is now pulled high again, the output $v_3$ will gradually rise unless and until it is reset by a low $v_2$ input which pulls $v_3$ to ground. If no motion is detected, $v_2$ is maintained high and the output $v_3$ will rise steadily towards the supply rail voltage $V_{DD}$, as constrained by the R-C time constant. If the duration between subsequent motion detection pulses under normal operation, $\tau$, is considerably less than the R-C time constant, the normal peak voltage level of $v_3$ before reset, $v_{nor}$, would be significantly less than the supply rail voltage $V_{DD}$.

By selecting a pre-determined threshold voltage $v_x$ which is significantly higher than $v_{nor}$, for example 5 to 10 times $v_{nor}$, power shut off can be signalled by detection of $v_3$ above $v_x$ which is indicative of an abnormally prolonged period of non-motion detection. In practice, a typical high speed motor for toy vehicle has a speed of 3300 rpm which means each complete revolution takes about 18 ms. Assuming this is the speed at which the motion tag rotates, i.e., $\tau$=18 ms. If a motor is allowed to be blocked for the duration which would otherwise be required for say 10 normal revolutions, the resulting delay would only be a matter of a few hundred milliseconds and would normally not be adequate to develop any damaging heat which may hurt a child.

In the above preferred embodiment, the safety of an electric toy vehicle is significantly enhanced by utilising a monitoring mechanism which is designed to trigger cut off of the power supply to the motor when there is prolonged non-rotation of the motor shaft. In particular, the monitoring device generates a monotonously incremental test signal level, $v_3$, which will be reset to a reset state upon successful detection of rotor shaft motion. Under normal operating conditions, the relative motion between the rotor shaft and the body of the vehicle causes a motion detection sensor to generate a periodic signal which will then periodically reset the test signal level. When there is no reset signal for a prolonged duration, indicating non-detection of relative motion, the incremental test signal will continue to grow and reach a pre-determined signal level, $v_x$, in the present embodiment, at and above which level a control circuit will cut off motor power supply to prevent damage. Likewise, the monitoring signal can be time decremental so that, in the absence of a resetting signal which restores the monitoring signal level to its starting state, it will drop and reach a predetermined signal level at which point the control circuit will operate to cut off power supply.

Since the normal peak output voltage of the detection circuitry is usually much lower than the supply voltage and the building up of the test voltage is substantially governed by the RC-constant at the output, the time required for reaching the cut-off monitoring signal level is usually very small and is very well predictable, this makes the present embodiment suitable for large scale manufacturing a reduced costs and with high repeatability.

Figure 5:
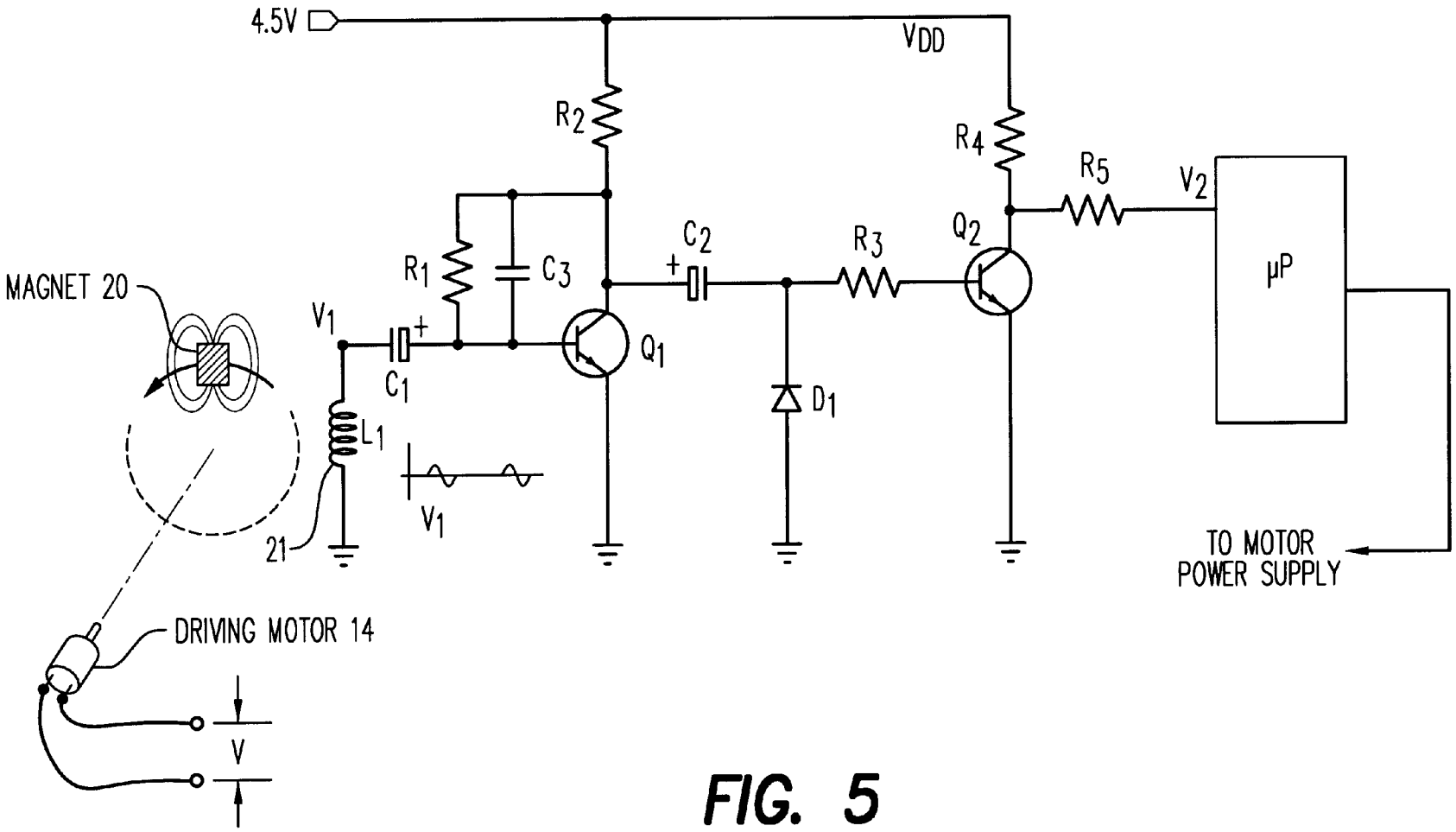
FIG. 5 is a circuit diagram of an alternative embodiment of the invention.

Alternatively, as shown in FIG. 5, the presence or absence of motion pulses can be verified by means of a micro-processor which can count the signal pulses generated by the motion sensor pairs to determine the lapsed time since the last detection of motion pulses in order to decide whether to cut off power supply to the motor.

I claim:

1. A toy vehicle having an electric motor with a rotary shaft for driving said vehicle, comprising a motion tag, a motion sensor and a motion detection device, wherein said motion tag comprises a permanent magnet attached to a gear disc of a transmission system of said vehicle and is movable in response to rotation of said rotary shaft, said motion sensor comprises a plurality of coils adapted for non-contact detection of motion of said motion tag and generates a characteristic electrical signal output in response to movement of said motion tag, and said motion detection device accepts and processes said characteristic electrical signal output from said motion sensor and is adapted to trigger cut-off of power supply to said electric motor when said characteristic output signal indicates that there has been no relative motion between the motion tag and the motion sensor for a predetermined duration.

2. A toy vehicle according to claim 1, wherein said motion detection device generates a monotonously time-incremental signal level output which is reset upon detection of said characteristic electrical signal output generated by said motion sensor in response to relative motion between said motion tag and said motion sensor, if said time-incremental signal output is not reset before reaching a pre-determined threshold signal level output, the power supply to said electric motor will be cut-off.

3. A toy vehicle according to claim 1, wherein said motion detection device generates a monotonously time-decremental signal level output which is reset upon detection of said characteristic electrical signal output generated by said motion sensor in response to relative motion between said motion tag and said motion sensor, and if said time-decremental signal output is not reset before reaching a pre-determined threshold signal level output, the power supply to said electric motor will be cut-off.

4. A toy vehicle having an electric motor with a rotary shaft for driving said vehicle, comprising a motion tag, a motion sensor and a motion detection device, wherein said motion tag is an aperture formed on a gear disc of a transmission system of said vehicle and is movable in response to rotation of said rotary shaft, said motion sensor comprises an optical source and an optical detector adapted for non-contact detection of motion of said motion tag and generates a characteristic electrical signal output in response to movement of said motion tag, and said motion detection device accepts and processes said characteristic electrical signal output from said motion sensor and is adapted to trigger cut-off of power supply to said electric motor when said characteristic output signal indicates that there has been no relative motion between the motion tag and the motion sensor for a predetermined duration.

5. A toy vehicle according to claim 4, wherein said motion detection device comprises means to determine the presence or absence of signal pulses within a pre-determined time.

6. A toy vehicle according to claim 5, wherein said motion detection device comprises a micro-processor for counting said signal pulses.

7. A toy vehicle according to claim 1, wherein said characteristic signal output from said motion sensor indicating motion comprises a pulsed signal.

8. A toy vehicle according to claim 7, wherein said pulsed signal is converted into a signal notch during its passage through said motion detection device.

* * * * *